US012109448B1

(12) United States Patent
Nolan et al.

(10) Patent No.: US 12,109,448 B1
(45) Date of Patent: Oct. 8, 2024

(54) ISOLATOR ARMS EXERCISE ATTACHMENT AND EXERCISE SYSTEM

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

(73) Assignee: Bulletproof Fitness Equipment Inc, Acton, MA (US)

( * ) Notice: Subject to any disclaimer, the term of this patent is extended or adjusted under 35 U.S.C. 154(b) by 0 days.

(21) Appl. No.: 18/400,589

(22) Filed: Dec. 29, 2023

Related U.S. Application Data

(60) Provisional application No. 63/436,057, filed on Dec. 29, 2022.

(51) Int. Cl.
*A63B 21/00* (2006.01)
*A63B 17/04* (2006.01)
*A63B 21/16* (2006.01)

(52) U.S. Cl.
CPC ..... *A63B 21/00065* (2013.01); *A63B 17/04* (2013.01); *A63B 21/16* (2013.01); *A63B 2210/50* (2013.01)

(58) Field of Classification Search
CPC ... A63B 21/00065; A63B 17/04; A63B 21/16; A63B 2210/50
See application file for complete search history.

(56) References Cited

U.S. PATENT DOCUMENTS

| | | | | |
|---|---|---|---|---|
| 5,277,684 | A * | 1/1994 | Harris | A63B 23/03533 482/121 |
| 5,437,589 | A * | 8/1995 | Habing | A63B 23/03541 482/136 |
| 5,967,954 | A * | 10/1999 | Habing | A63B 21/159 482/137 |
| 11,173,337 | B2 * | 11/2021 | Jones | A63B 21/0615 |
| 11,229,822 | B1 * | 1/2022 | Manula | A63B 21/4047 |
| 11,458,349 | B1 * | 10/2022 | Carlson | A63B 21/4035 |
| 2007/0155595 | A1 * | 7/2007 | Rogers | A63B 21/08 482/97 |
| 2019/0275363 | A1 * | 9/2019 | Jones | A63B 21/0616 |
| 2020/0094096 | A1 * | 3/2020 | Sorin | A63B 21/4033 |
| 2020/0222745 | A1 * | 7/2020 | Leipheimer | A63B 23/03525 |
| 2021/0086016 | A1 * | 3/2021 | Fennell | A63B 21/0726 |
| 2022/0379157 | A1 * | 12/2022 | Pritchett | A63B 21/0626 |

* cited by examiner

*Primary Examiner* — Andrew S Lo
(74) *Attorney, Agent, or Firm* — AVEK IP, LLC

(57) ABSTRACT

An isolator arms attachment for an exercise system includes a first arm having a first receiver assembly to engage with a first user engageable device; a first shaft coupled to the first arm and to connect the first arm to the exercise system; and a first counterweight assembly coupled to the first arm near a second end. A second arm having a second receiver assembly to engage with a second user engageable device; a second shaft coupled to the second arm near the second end and to connect to the exercise system; and a second counterweight assembly coupled to the second arm near the second end. The first arm and the second arm are to be manipulated by a user such that the first arm and the second arm provide resistance to the user.

21 Claims, 13 Drawing Sheets

ISOLATOR ARMS EXERCISE ATTACHMENT AND EXERCISE SYSTEM

RELATED APPLICATIONS

This application claims the benefit of U.S. provisional application 63/436,057 filed Dec. 29, 2022, which is incorporated by reference in its entirety herein.

FIELD OF INVENTION

The disclosure relates generally to exercise equipment. More specifically, the disclosure relates to isolator arms exercise attachment and exercise system that utilizes the isolator arms to provide a user with a plurality of exercise options with minimal equipment and reduced gym or home footprint.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes an isolator arms attachment for an exercise system, the isolator arms attachment comprising a first arm extending from a first end to a second end, and a second arm extending from a first end to a second end. The first arm having a first receiver assembly positioned at the first end, the first receiver assembly configured to engage with a first user engageable device; a first shaft coupled to the first arm near the second end, the first shaft configured to connect the first arm to the exercise system; and a first counterweight assembly coupled to the first arm near the second end. The second arm having a second receiver assembly positioned at the first end, the second receiver assembly configured to engage with a second user engageable device; a second shaft coupled to the second arm near the second end, the second shaft configured to connect the second arm to the exercise system; and a second counterweight assembly coupled to the second arm near the second end. The first arm and the second arm are configured to be manipulated by a user such that the first arm and the second arm provide resistance to the user.

According to another embodiment of the current disclosure, the present invention relates to an exercise system with an isolator arms attachment, comprising a support structure with a first vertical post and a second vertical post; a first carriage adjustably secured to the first vertical post, the first carriage having a first set of carriage receivers; a second carriage adjustably secured to the second vertical post, the second carriage having a second set of carriage receivers; a first arm extending from a first end to a second end; and a second arm extending from a first end to a second end. The first arm having a first receiver assembly positioned at the first end, the first receiver assembly configured to engage with a first user engageable device; a first shaft coupled to the first arm near the second end, the first shaft configured to connect the first arm to the exercise system; and a first counterweight assembly coupled to the first arm near the second end. The second arm having a second receiver assembly positioned at the first end, the second receiver assembly configured to engage with a second user engageable device; a second shaft coupled to the second arm near the second end, the second shaft configured to connect the second arm to the exercise system; and a second counterweight assembly coupled to the second arm near the second end. The first arm and the second arm are configured to be manipulated by a user such that the first arm and the second arm provide resistance to the user.

According to another embodiment of the current disclosure, the present invention relates to an isolator arm as part of an exercise system, the isolator arm comprising a first section and a second section, the second section extending away from the first section at an angle between 180 degrees and 90 degrees; a receiver assembly positioned at a first end of the isolator arm, the receiver assembly being a first hexagonal opening and a second hexagonal opening into the first section of the isolator arm; a first locking pin extending into the first receiver to lock a user engageable device therein; a second locking pin extending into the second receiver to lock the user engageable device therein; a counterweight assembly removably attached to the second section of the isolator arm, the counterweight assembly having a counterweight plate supporting a counterweight, the counterweight plate configured to couple to the second section via a counterweight locking pin; a bearing shaft positioned at the second end of the isolator arm; an adjustment plate attached to the bearing shaft; a shaft bolt integral with a shaft, the shaft bolt configured to extend through the bearing shaft such that the bearing shaft and the isolator arm can rotate around the shaft bolt; and a locking pin configured to lock the isolator arm at a position about the shaft bolt by extending through the adjustment plate. The isolator arm is configured to be manipulated by a user and provide resistance to the user.

BRIEF DESCRIPTION OF THE DRAWINGS

Embodiments of the invention are described in detail below with reference to the attached drawings.

Figure 1:
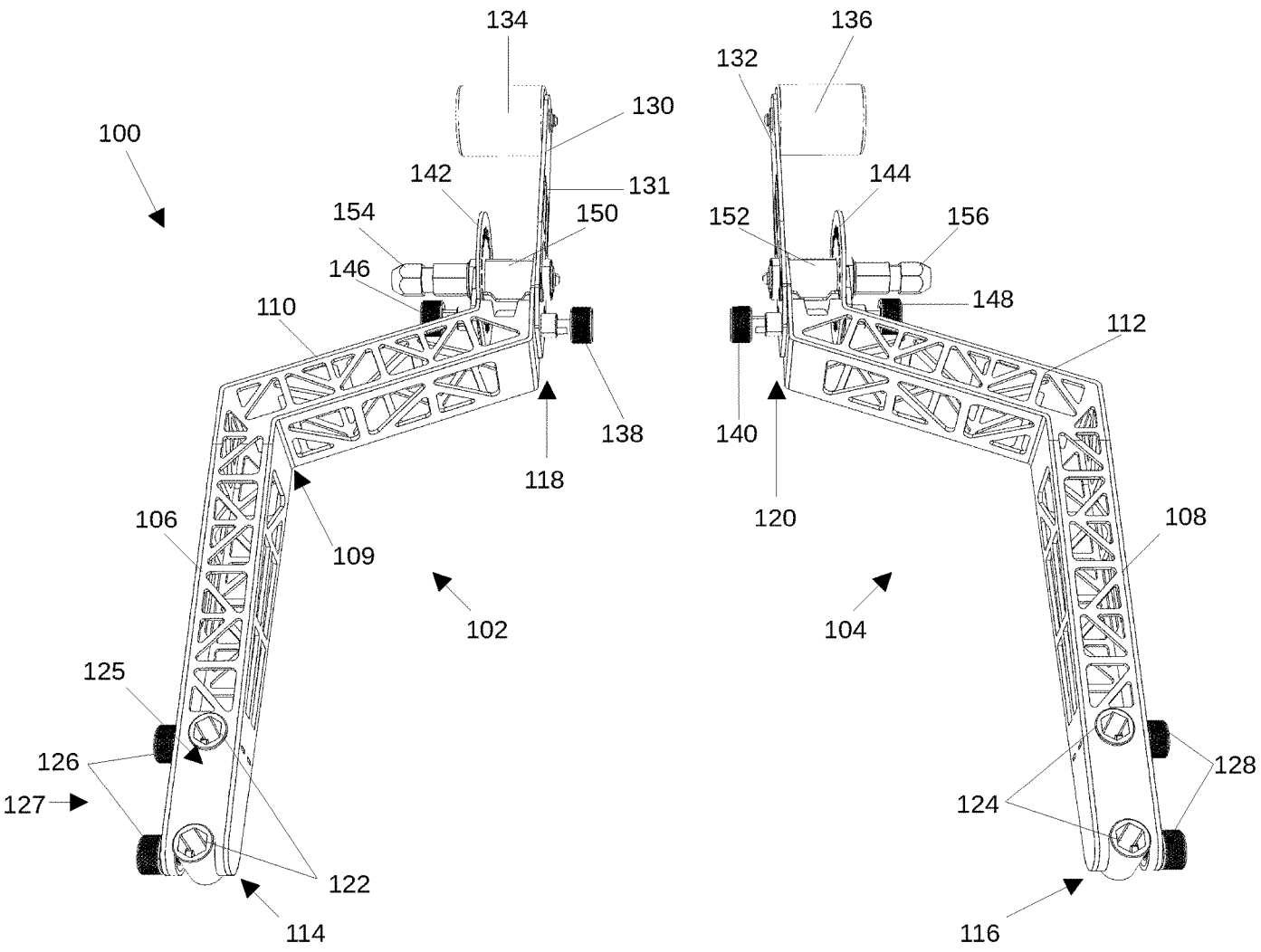
FIG. 1 is a top angled view of an isolator arms attachment in accordance with the present invention.

The drawings do not limit the invention to the specific embodiments disclosed and described herein. The drawings are not necessarily to scale, emphasis instead being placed upon clearly illustrating various principles of the disclosure.

LIST OF REFERENCES

100—Isolator Arms Attachment
102—First Arm
104—Second Arm
106—First Section of First Arm
108—First Section of Second Arm
109—Angle between First Section and Second Section
110—Second Section of First Arm
112—Second Section of Second Arm
114—First End of First Arm
116—First End of Second Arm
118—Second End of First Arm
120—Second End of Second Arm
122—Receivers of First Arm
124—Receivers of Second Arm
125—Top surface of First Arm
126—Locking Pins of First Arm
127—Outward Side of First Arm
128—Locking Pins of Second Arm
130—Counterweight Assembly
131—Counterweight Plate
132—Counterweight Assembly
134—Counterweight
136—Counterweight
138—Spring Loaded Locking Pin
140—Spring Loaded Locking Pin
142—Adjustment Plate
144—Adjustment Plate
146—Spring Pin
148—Spring Pin
150—Bearing Shaft
152—Bearing Shaft
154—Hex Shaft
156—Hex Shaft
200—Shaft Bolt
202—Shaft Bolt
300—Exercise System
302—Support structure
304—Vertical Post
306—Vertical Post
308—Receiver
310—Receiver
311—Receiver
312—Receiver
314*a*-Locking Pin
316—Carriage
318—Carriage
320—Weight Arm
322—Weight Arm
324—Weights
326—Weights
328—Handle
330—Handle
332—Supporting Plate
334—Supporting Plate
336—Bench
400—Exercise System
402—Foot Plate
404—Bar
406—Coupler
408—Supporting Plate
500—Exercise System
600—Exercise System
800—Exercise System
802—Alternative Weight Arm
804—Alternative Weight Arm
1000—Exercise System
1002—Isolator Arm
1004—Adjustable Weight Arm
1006—Main Bar
1008—Sleeve
1010—Locking Pin
1012—Coupler Sleeve
1014—Locking Pin
1016—Weights
1018—Weight Receiver

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on exercises they desire to perform. It is desirable for exercise machines to be versatile and easy to operate and configure, thereby allowing for a user to perform multiple exercises with limited equipment. In addition, it is desirable for equipment to take up a small footprint in both home use and gym use, thereby reducing the need for large areas. And lastly, it is desirable for equipment to be easily stored and transported from one location to another.

The present invention provides for an isolator arms attachment with a first arm and a second arm, wherein the arms are configured to be attached to a support structure and configurable for use in multiple arrangements. Each arm is created into a lattice design, preferably out or a metal, thereby reducing the weight of the arm. In addition, each arm includes a receiver assembly for receiving a user engageable device, such as a handle or a foot plate. Each arm further comprises an adjustment mechanism, wherein an angle of the arm can be manipulated, again to allow for use in multiple arrangements. Accordingly, the arms of the present invention are easily manipulated, stored, and used in a plurality of exercises.

Figure 2:
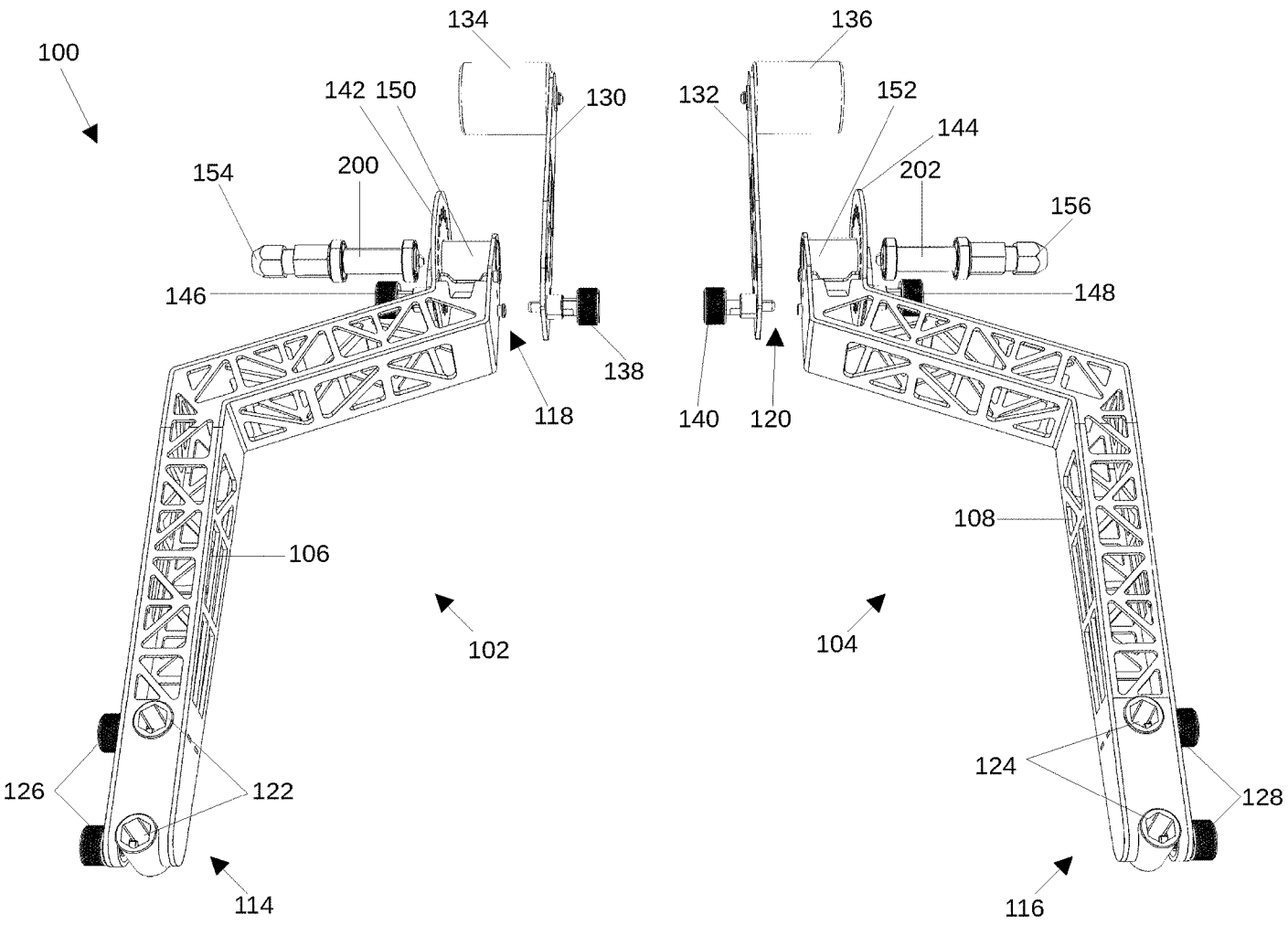
FIG. 2 is a top angled view of the isolator arms attachment of FIG. 1 in a disassembled configuration.

FIGS. 1 and 2 show the isolator arms attachment 100 with a first arm 102 and a second arm 104. As shown, the arms 102, 104 are mirror images of one another, and accordingly, the teachings and descriptions for one arm herein can be applied to the other arm as would be understood by those skilled in the art. It should be appreciated that the arms may be used together, or as a single arm depending on the needs of the user.

Each arm 102, 104 includes a first section 106, 108 and a second section 110, 112. As shown, the sections are connected at an angle 109, wherein the angle 109 is greater than 90 degrees but less than 180 degrees. This connection allows for the arms 102, 104 to extend outward at a wide angle which provides for diverse uses by the user. Further, each arm 102, 104 is made up of a lattice/open weave configuration as opposed to being a solid bar/body. This design greatly reduces the overall weight of each arm, while still ensuring structural integrity and strength. Accordingly, the arms can be easily removed and stored or rearranged into various configurations.

Each arm 102, 104 extends from a first end 114, 116 to a second end 118, 120. The first ends 114, 116 support receiver assemblies, namely receivers 122, 124 with locking pins 126, 128. In at least some embodiments, the receivers 122, 124 are hexagonal shaped openings or ports that extend into the associated arm from a top surface 125. The use of dual receivers ensures that user engageable devices are securely affixed to the associated arm. In addition, the locking pins 126, 128 extend from an outer side 127 of the associated arm, which ensures the locking pins do not obstruct or otherwise hinder use of the user engageable devices. The hexagonal shape of the receivers 122, 124 aids in creating a tight lock/retention on inserted shafts of a user engageable device, preventing rotation or shifting of the user engageable device.

On the second ends 118, 120, of each of the arms 102, 104, are counterweight assemblies 130, 132 each having a counterweight 134, 136 to aid in rotation around bearing bolts 200, 202. For example, counterweight 134 is attached to counterweight plate 131 which is then coupled to the second end 118 of the first arm 102 via a spring-loaded locking pin 138. Similarly, a spring-loaded locking pin 140 secures the second counterweight assembly 132 to the second arm 104.

Each arm is adjustable in an angle relative to a support structure (see FIGS. 3-7). The adjustability is accomplished via coupling of bearing bolts 200, 202 to a bearing shaft 150, 152. In other words, bearing shaft 150 is attached and integral with the first arm 102 and receives the bearing bolt 200 as shown in FIG. 2. The shaft 150 can then rotate around the bolt 200 such that the arm 102 also rotates to various angles. A spring pin 146 will lock the arm 102 at the desired angle via an adjustment plate 142 having a plurality of apertures. In other words, the spring pin 146 is pulled out, the arm 102 is rotated, and then the pin 146 inserts back through one of the apertures of the adjustment plate 142 to lock the arm 102 into the desired position. The second arm 104 includes the same features, namely the bearing shaft 152, bearing bolt 202, an adjustment plate 144, and a spring pin 148. Those skilled in the art will appreciate that alternative means of adjustability may be used. In embodiments, each arm can rotate up to 360 degrees for full customization of the angle.

Each arm 102, 104 further includes a hex shaft 154, 156 which in embodiments is coupled to and integral with the associated shaft bolt 200, 202. The hex shaft 154, 156 allows for the associated arm 102, 104 to attach to a support structure of an exercise assembly, as shown in FIGS. 3-7. Again, as discussed above, the use of a hexagonal cross section ensures a tight and secure lock together.

Figure 3:
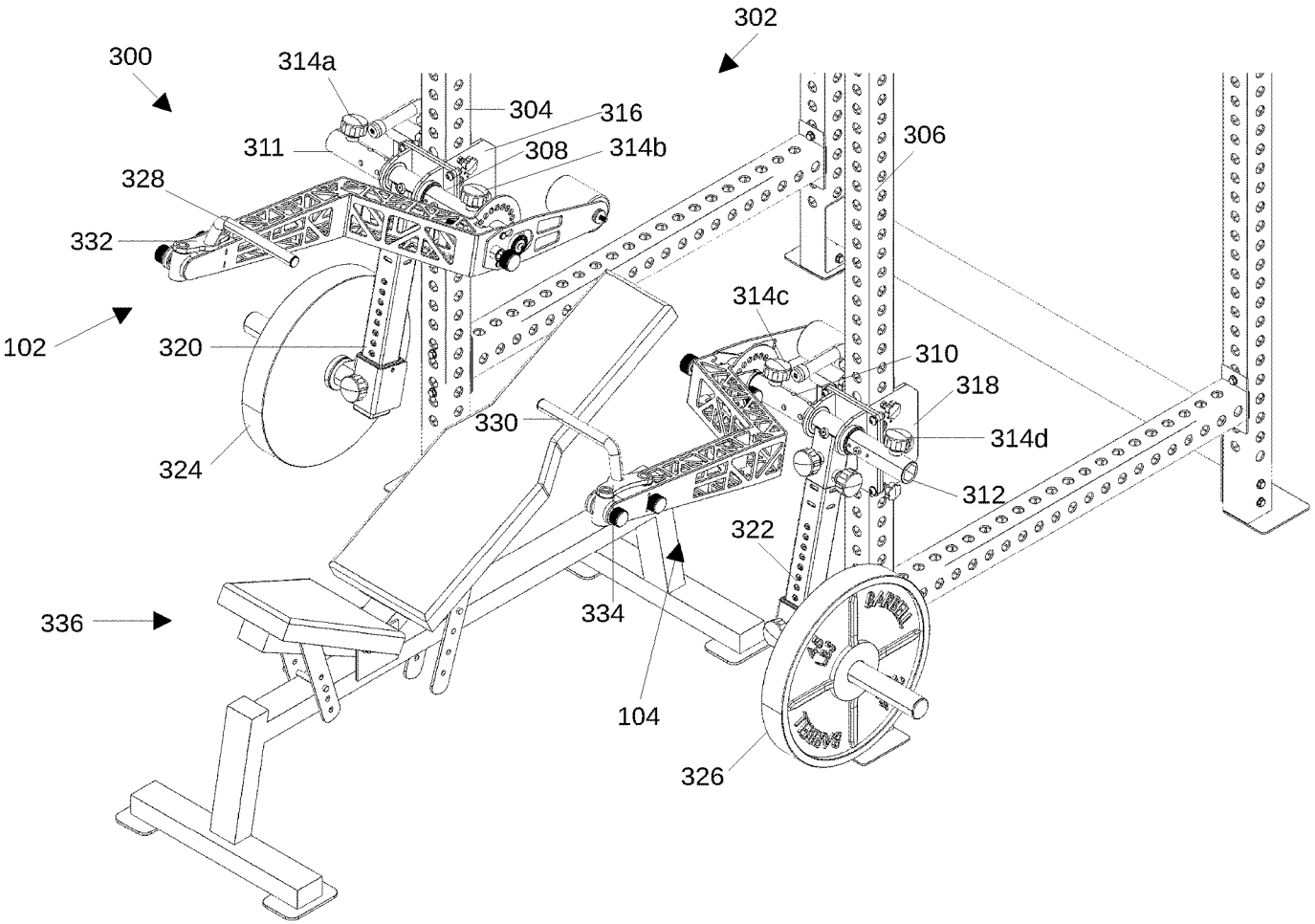
FIG. 3 is an angled side view of a first exercise system with the isolator arms attachment of FIG. 1.

In FIGS. 3-7, exercise systems are shown using the isolator arms attachment 100 for various uses. Those skilled in the art will appreciate that the description and teachings for each system can be applied to other systems and that the examples shown are non-limiting. As shown in FIG. 3, exercise system 300 includes a support structure 302 having a first vertical post 304 and a second vertical post 306. The arms 102, 104 are coupled to the vertical posts 304, 306 via carriage receivers 308, 310. As shown, the system 300 includes carriage receivers 308, 310, 311, 312 such that each carriage 316, 318 has at least two receivers, namely a right receiver and a left receiver. In other words, carriage 316 is adjustably attached to vertical post 304 and provides a left receiver 311 and a right receiver 308. This allows for attachment of one of the arms 102, 104 to either side. Locking pins 314*a-d* are used to lock the arms 102, 104 to the associated receivers. As would be understood by those skilled in the art, the hex shafts 154, 156 are used to insert into the associated receivers.

Although the configurations can vary, in embodiments, weight arms 320, 322 are also coupled to the carriages 316, 318 to receive and hold weights 324, 326. In the embodiment shown in FIG. 3, handles 328, 330 extend from supporting plates 332, 334 which are then coupled to the receivers 122, 124. Those skilled in the art will again appreciate that the handles 328, 330 can vary in style. During use, a user may utilize a bench 336 or may operate the arms 102, 104 from a standing position while engaging with the handles 328, 330 such that the weights 324, 326 provide weighted resistance.

Figure 4:
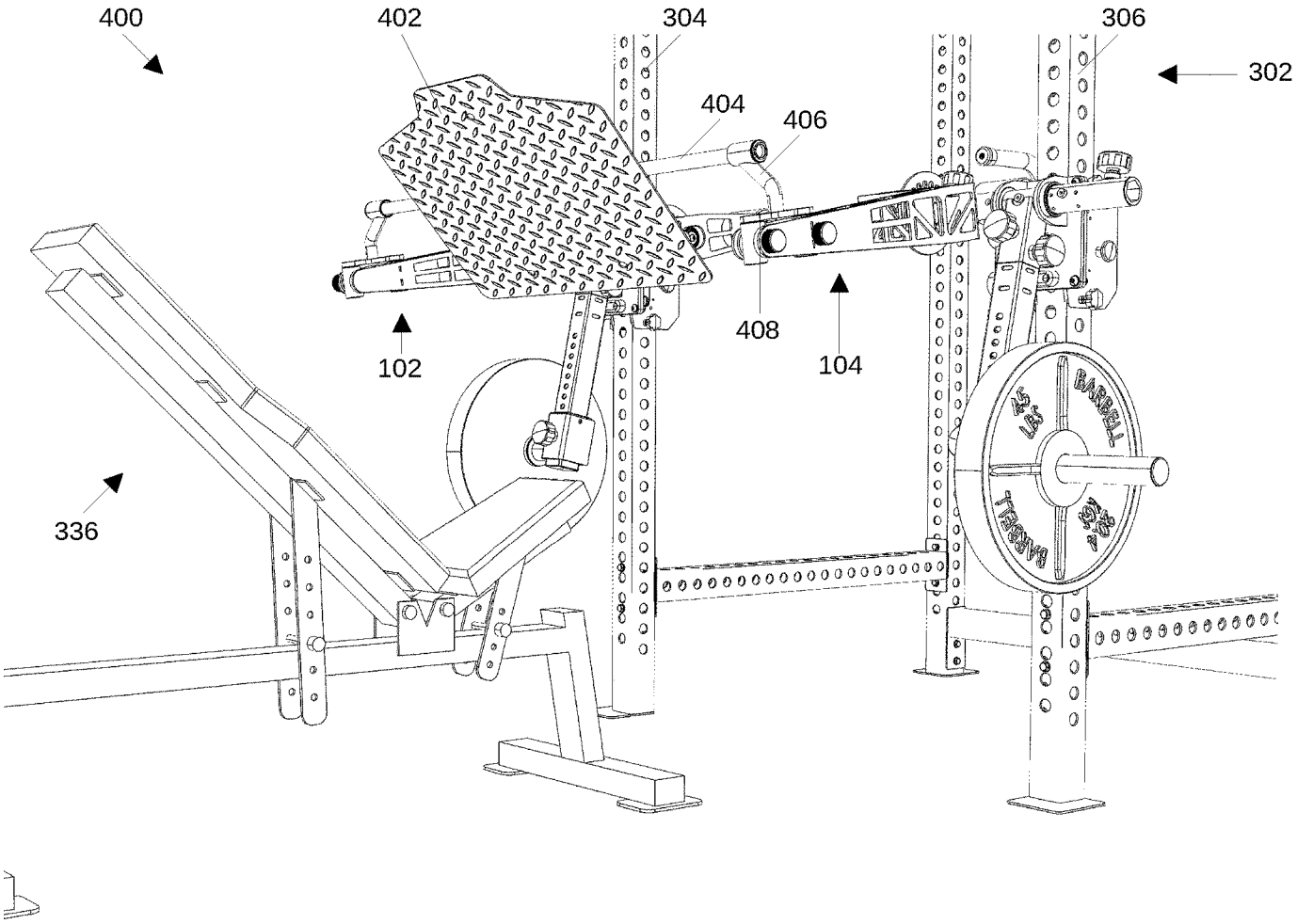
FIG. 4 is an angled side view of a second exercise system with the isolator arms attachment of FIG. 1.
Figure 5:
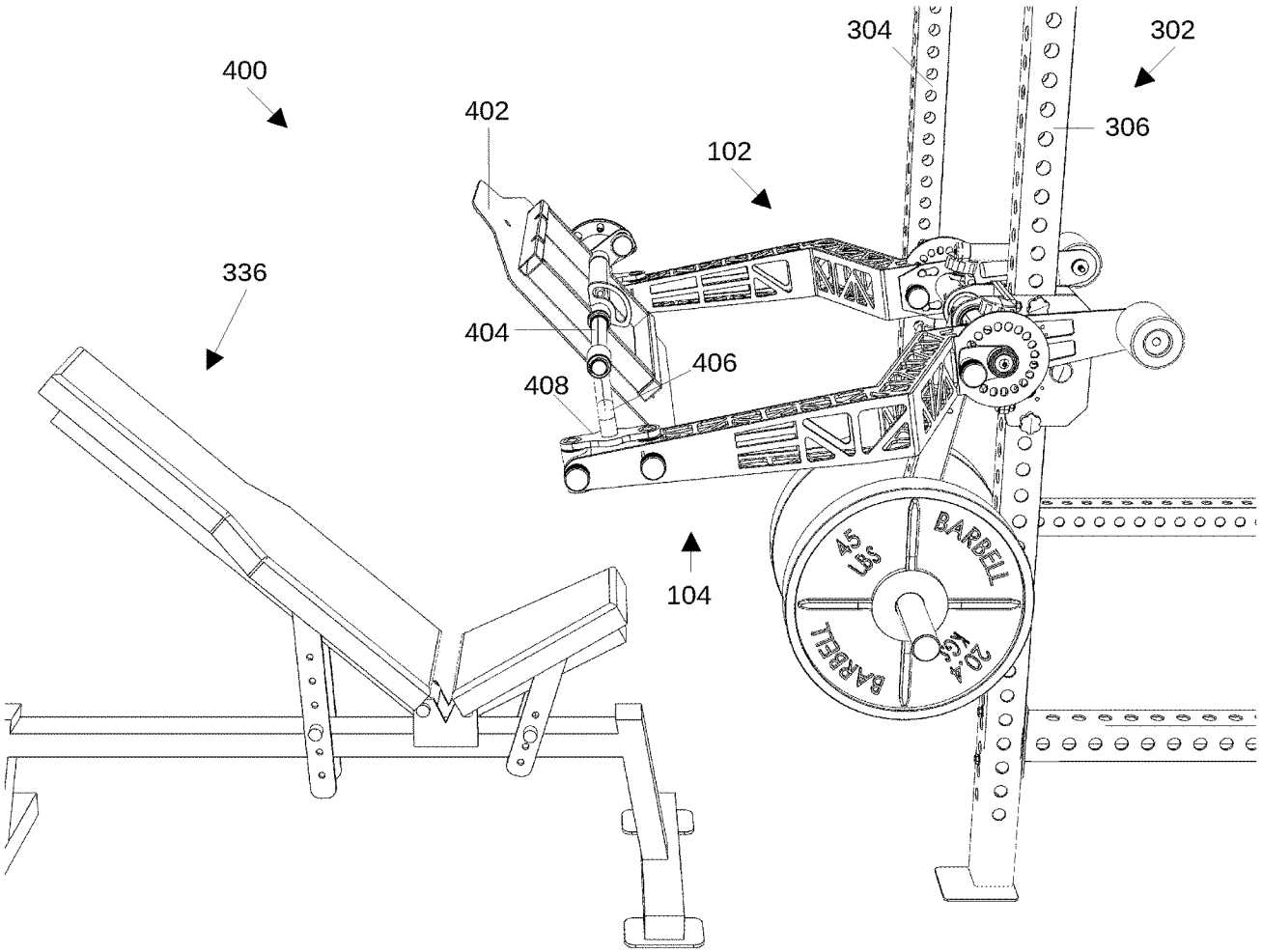
FIG. 5 is a side view of the second exercise system of FIG. 4.

In FIGS. 4 and 5, an exercise system 400 is shown with a foot plate 402. The foot plate 402 is supported by the arms 102, 104 such as via a bar 404 attached to a coupler 406 which is further attached to a supporting plate 408 to engage with the arm 104. Again, those skilled in the art will appreciate that the exact configuration of the foot plate can vary.

Figure 6:
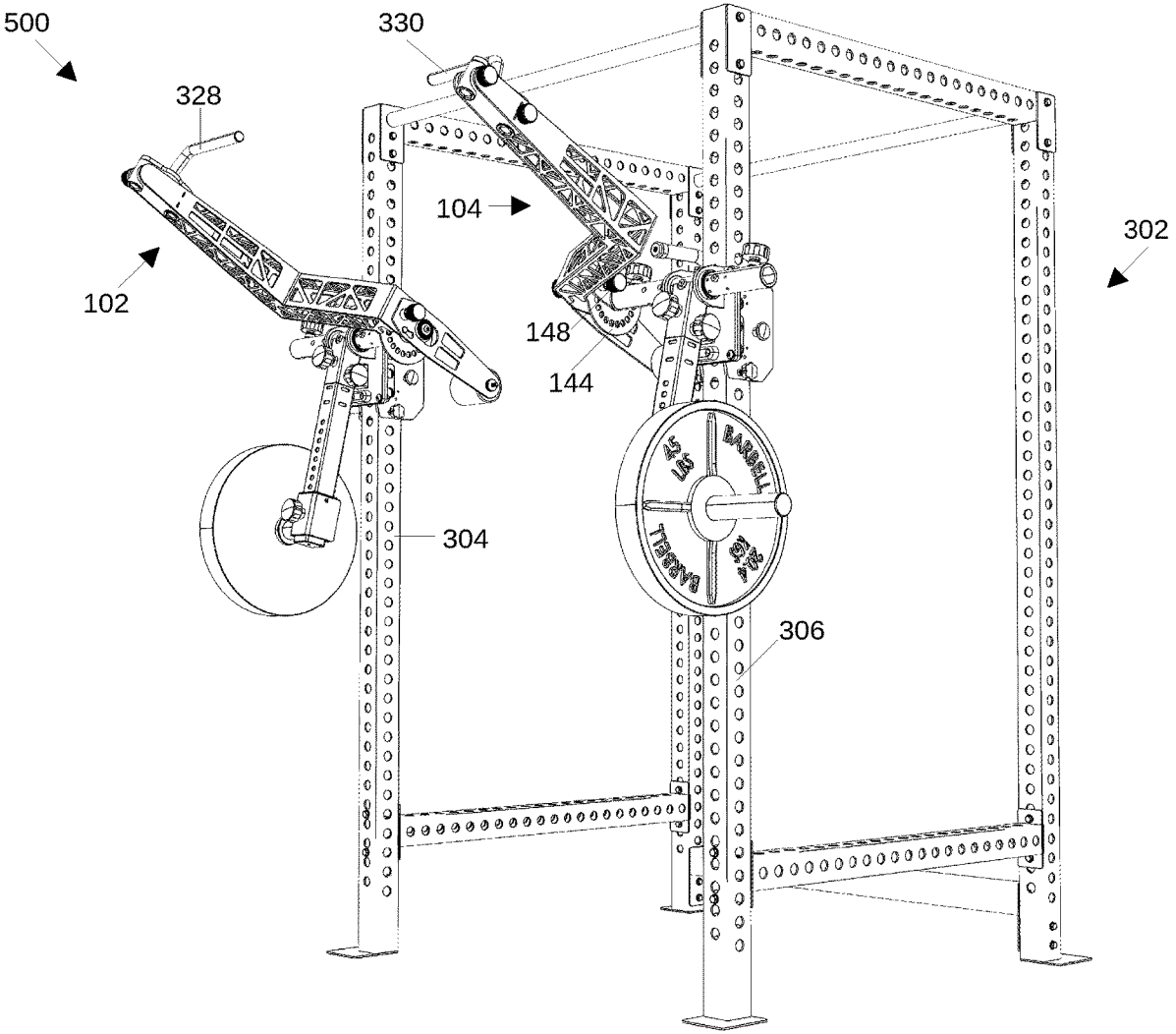
FIG. 6 is an angled side view of a third exercise system with the isolator arms attachment of FIG. 1.
Figure 7:
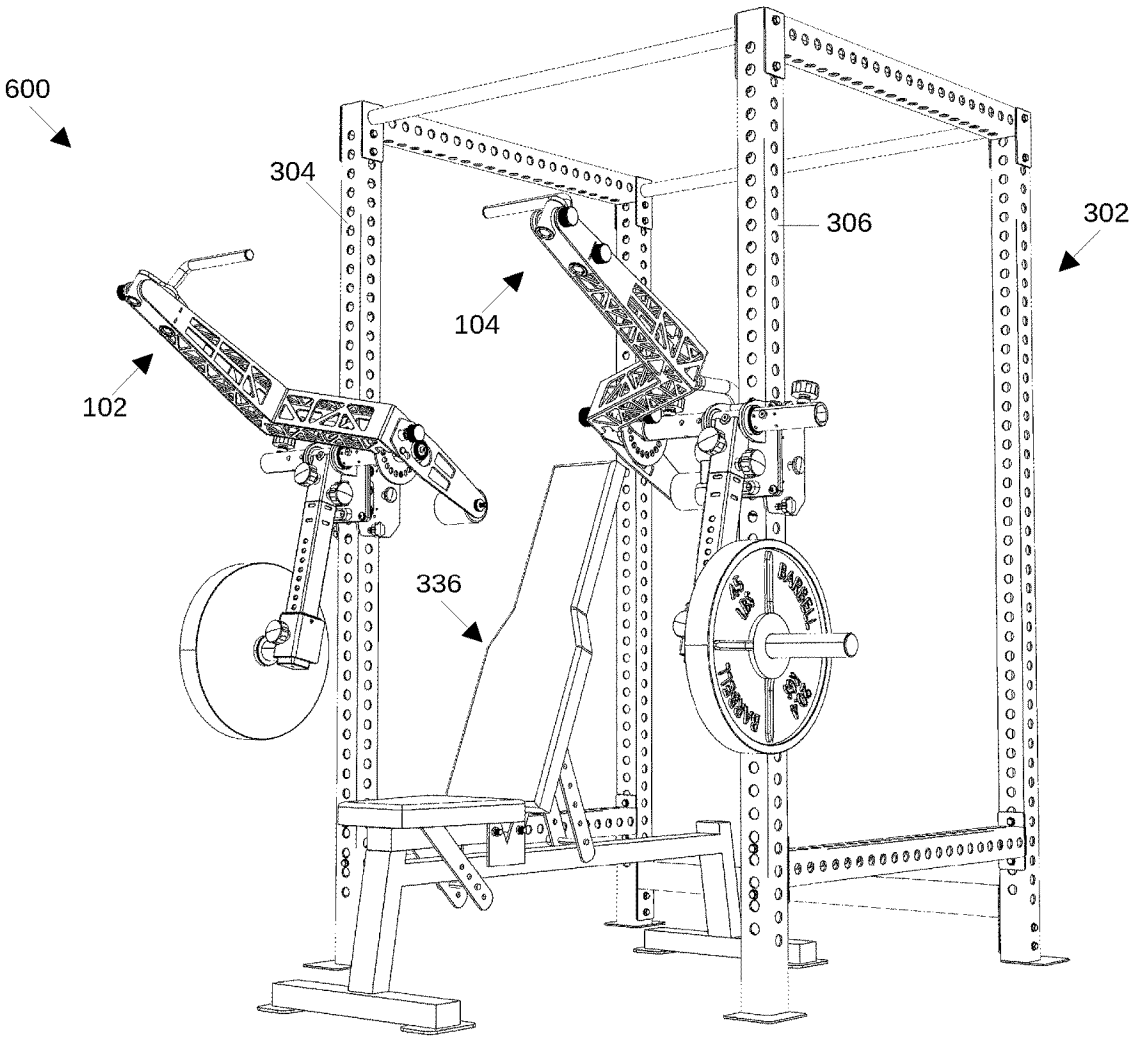
FIG. 7 is an angled side view of a fourth exercise system with the isolator arms attachment of FIG. 1.

In FIGS. 6 and 7, exercise systems 600, 700 demonstrate each arm 102, 104 with an angle adjusted. Specifically, as shown, the arms 102, 104 are lifted and rotated before being locked in place via pins 146, 148 and adjustment plates 142, 144. Here again, handles 328, 330 such as for a pulling down motion exercise. A bench 336 may be utilized as desired for the exercise being performed. Again, the examples shown are merely some of the configurations of the present invention.

Figure 8:
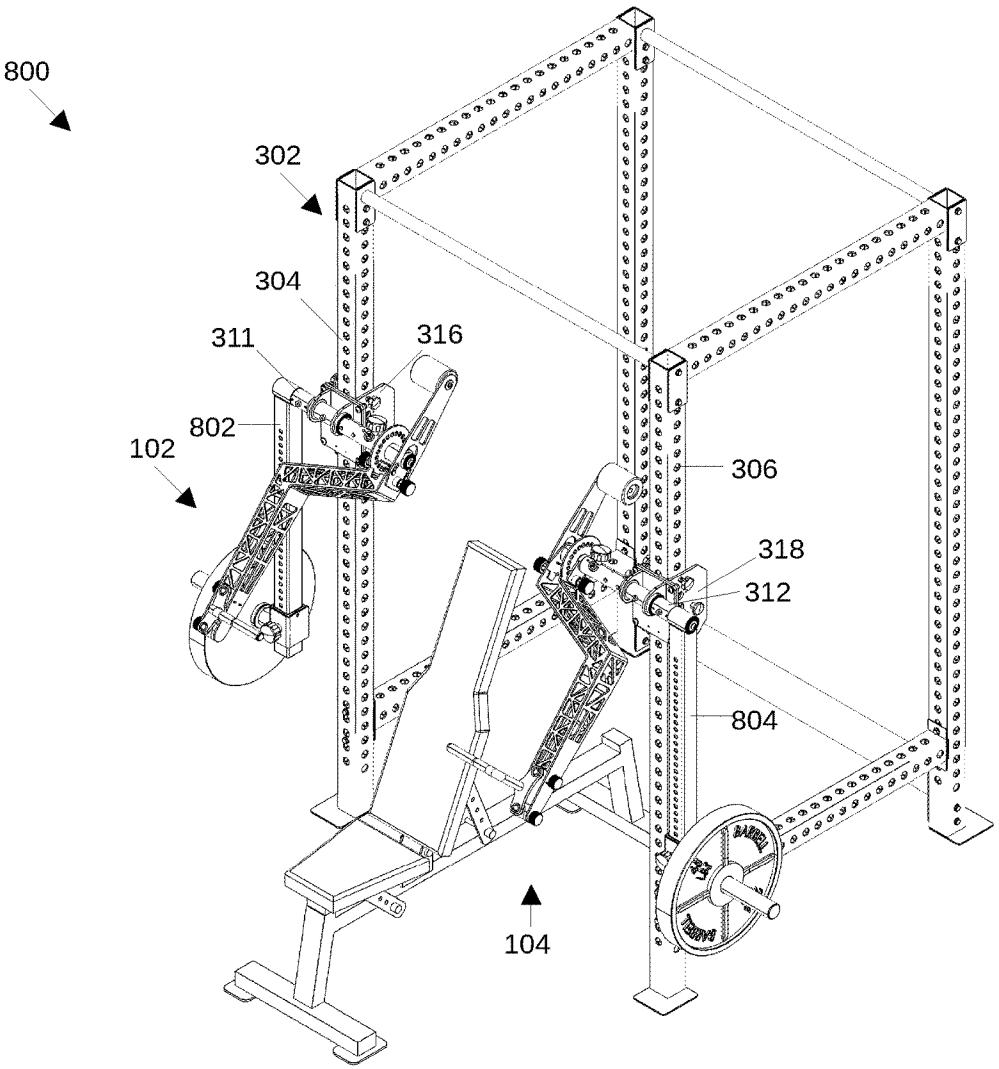
FIG. 8 is an angled side view of a fifth exercise system with the isolator arms attachment of FIG. 1.
Figure 9:
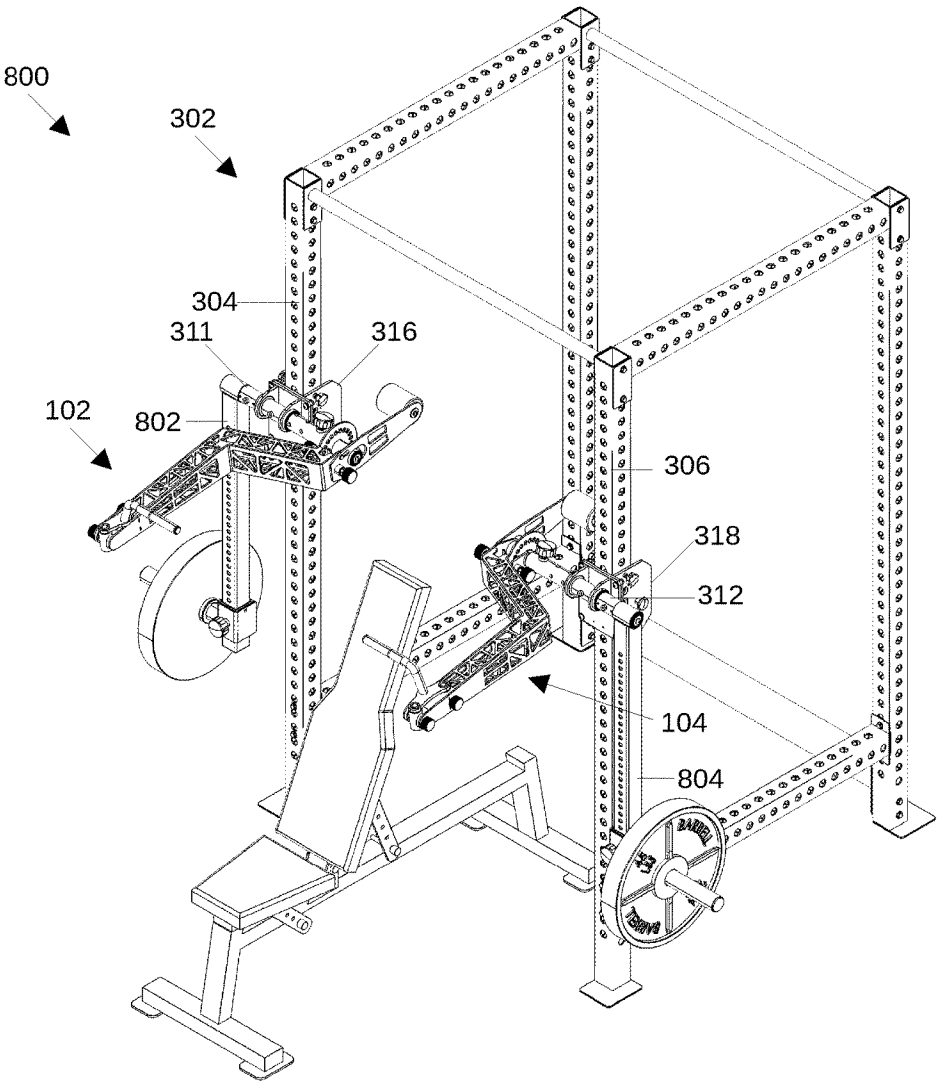
FIG. 9 is an angled side view of the fifth exercise system of FIG. 8 with the isolator arms attachment of FIG. 1 having the arms at an alternative angle.
Figure 10:
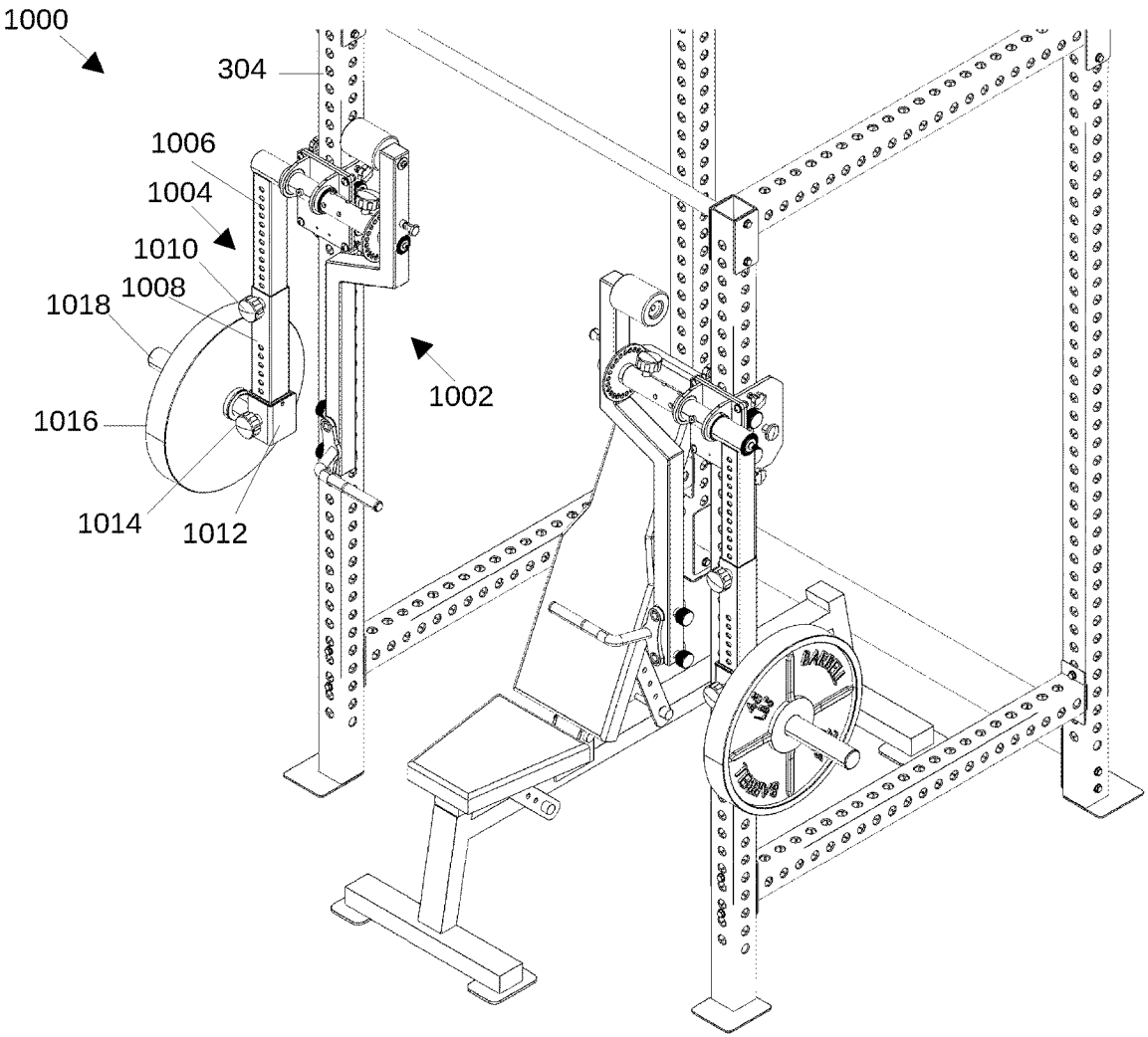
FIG. 10 is an angled side view of a sixth exercise system with an alternative embodiment of an isolator arms attachment and adjustable weight arms in accordance with the present invention.
Figure 11:
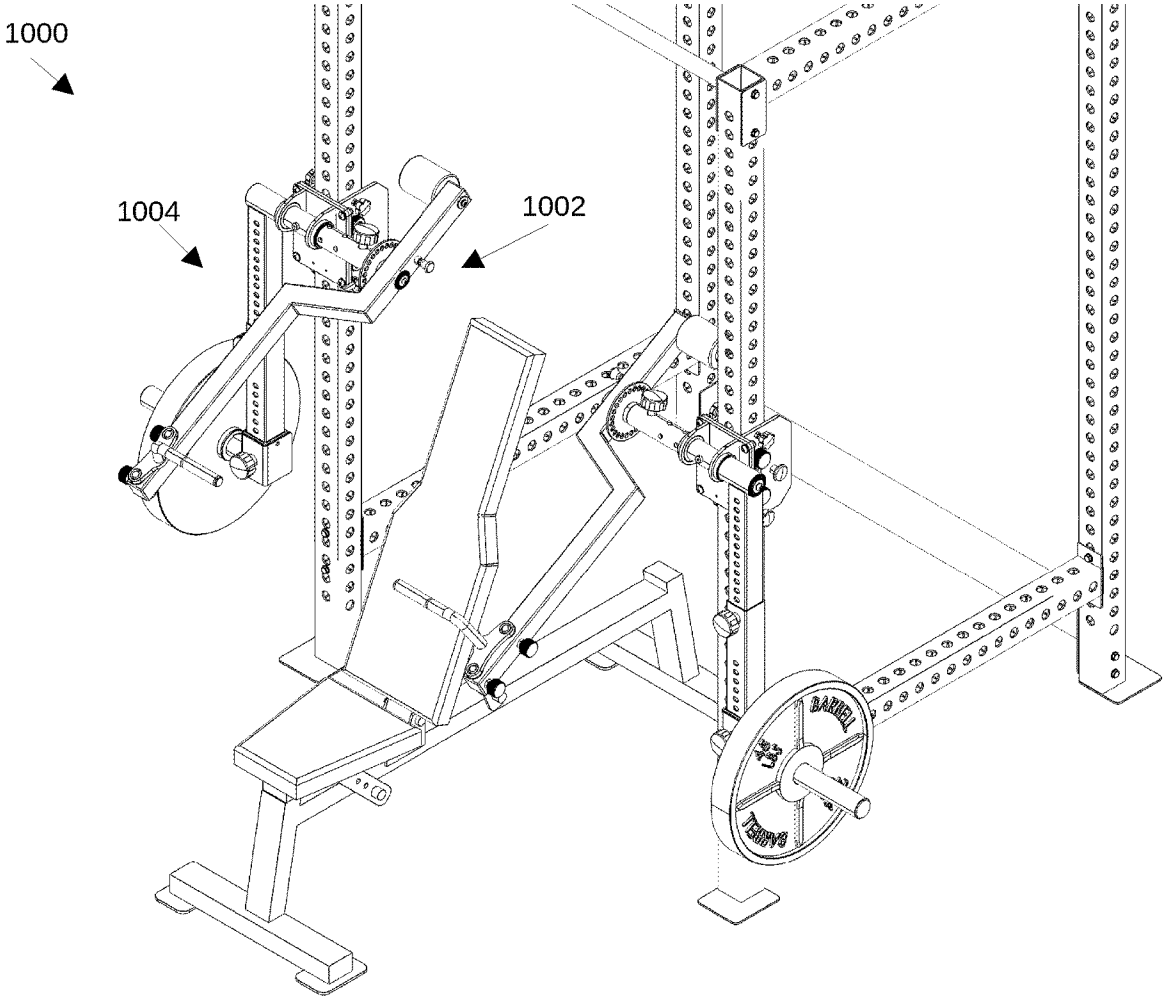
FIG. 11 is an angled side view of the sixth exercise system with the isolator arms attachment in a second angle and the weight arms at an adjusted length.
Figure 12:
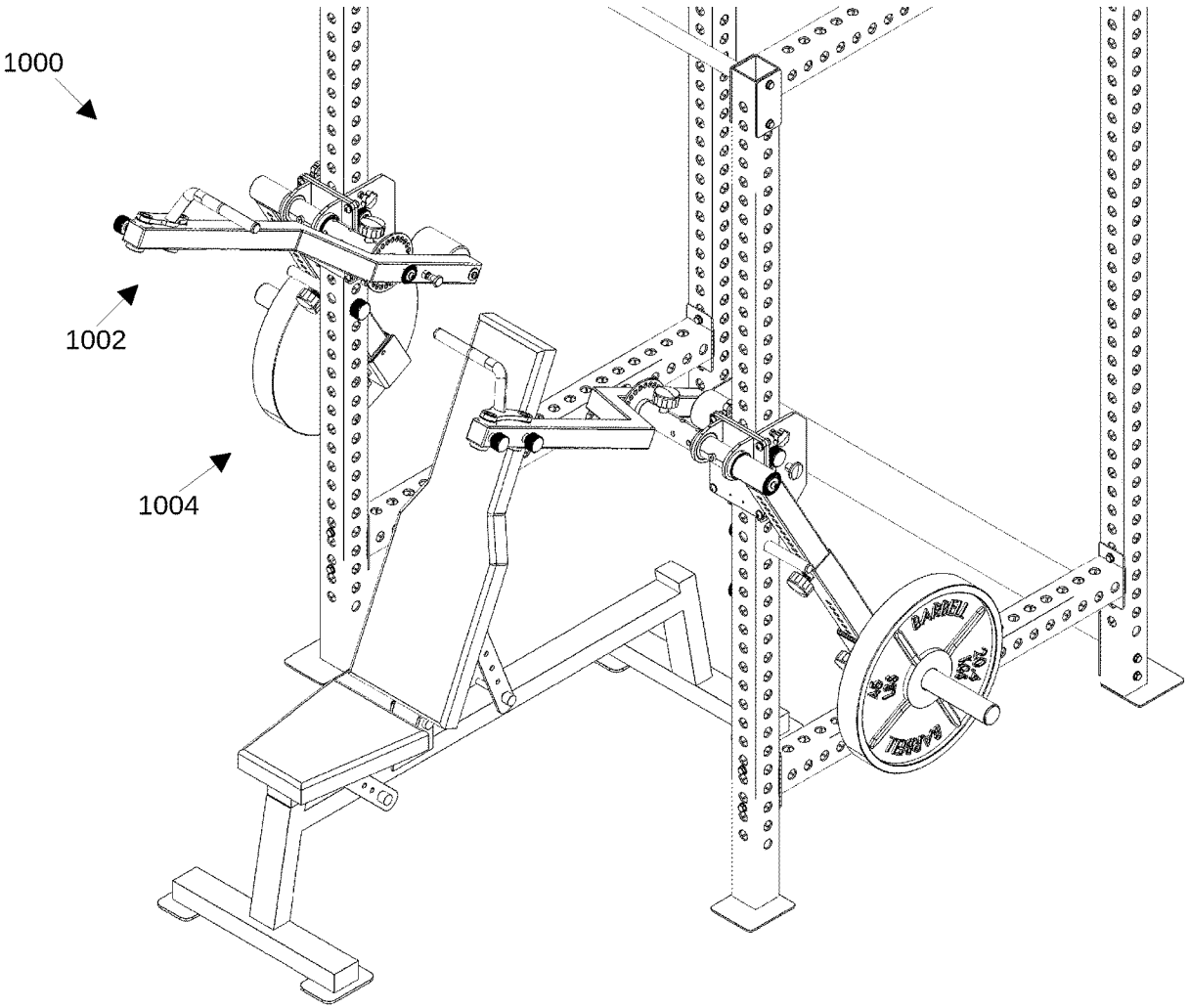
FIG. 12 is an angled side view of the sixth exercise system with the isolator arms attachment in a third angle.
Figure 13:
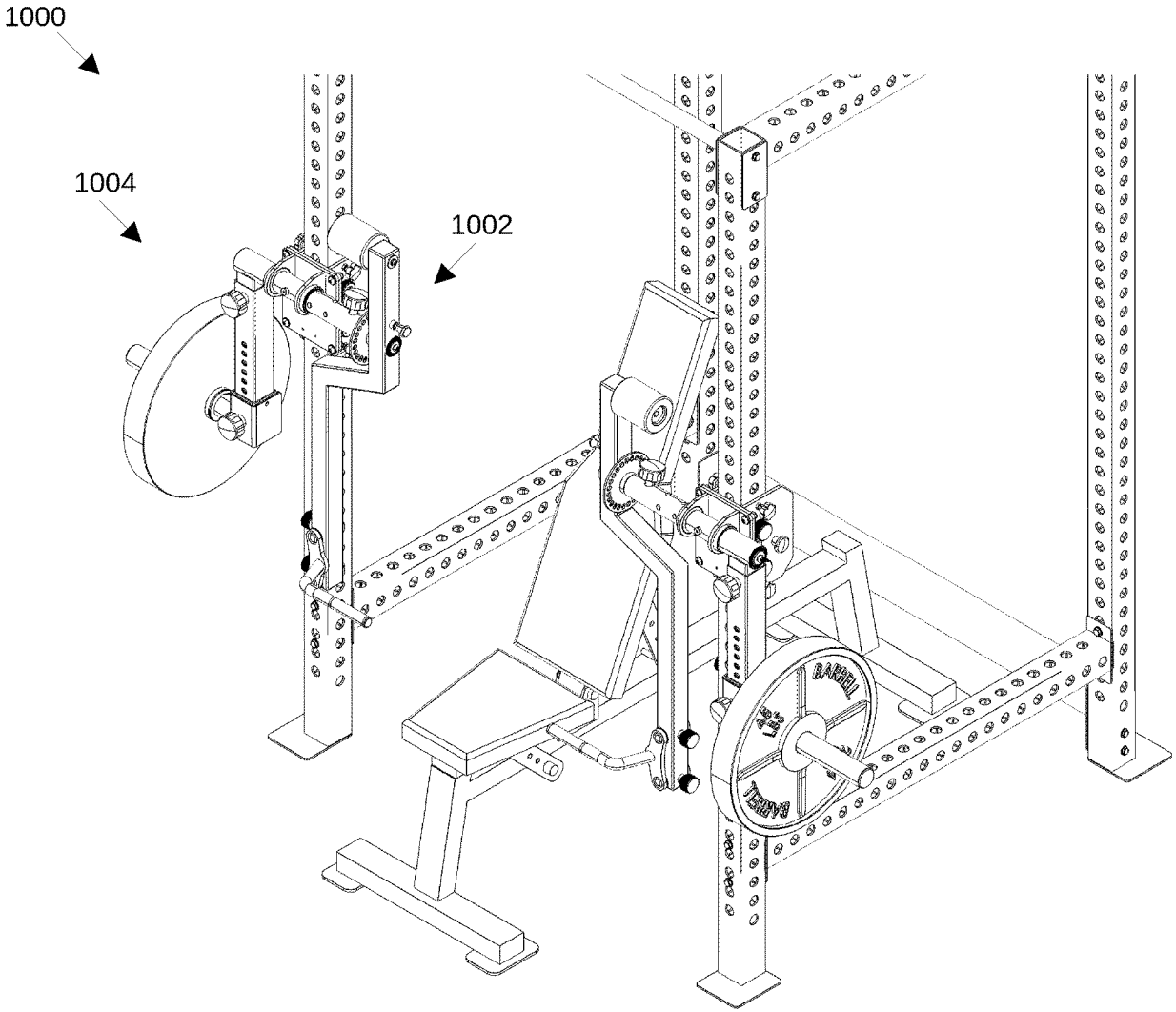
FIG. 13 is an angled side view of the sixth exercise system with the isolator arms attachment in a fourth angle.

In FIGS. 8 and 9, another exercise system 800 is shown. In system 800, alternative weight arms 802, 804 are connected to the associated carriages 316, 318 on outer carriage receivers 311, 312. In other words, the arms 102, 104 are positioned inside of the vertical posts 304, 306, while the weight arms are positioned on the outside of the vertical posts 304, 306. FIG. 9 demonstrates the arms 102, 104 in an alternate angle.

In FIGS. 10-13 another exercise system 1000 is shown. This system demonstrates an alternative embodiment of an isolator arm 1002 and an adjustable weight arm 1004. The adjustable weight arm 1004 includes a main bar 1006 with a plurality of apertures and a sleeve 1008 coupled to the main bar 1004 via a locking pin 1010 extending through one of the plurality of apertures. The sleeve 1008 supports a coupler sleeve 1012 via another locking pin 1014 and plurality of apertures. Accordingly, the overall length of the weight arm can be adjusted as demonstrated in FIGS. 10-13. The coupler sleeve 1012 provides a means to attach a weight receiver 1018 with one or more weights 1016. Accordingly, the isolator arm 1002 can adjust in angle, and the weight arm 1004 can adjust in length, again providing a user with additional customization. Although only one adjustable weight arm and one isolator arm are labeled, those skilled in the art will appreciate that the second isolator arm and second adjustable weight arm include substantially the same features, or mirror images of the discussed features.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. An isolator arms attachment for an exercise system, the isolator arms attachment comprising:

a first arm extending from a first end to a second end, the first arm having:

a first receiver assembly positioned at the first end, the first receiver assembly configured to engage with a first user engageable device, the first receiver assembly having a first receiver with a first locking pin and a second receiver with a second locking pin, the first receiver and the second receiver are each a hexagonal shaped opening extending into the first arm from a top surface of the first arm and the first locking pin and the second locking pin extend into the first receiver and the second receiver from an outward side of the first arm;

a first shaft coupled to the first arm near the second end, the first shaft configured to connect the first arm to the exercise system; and a first counterweight assembly coupled to the first arm near the second end;

a second arm extending from a first end to a second end, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

wherein the first arm and the second arm are configured to be manipulated by a user such that the first arm and the second arm provide resistance to the user.

2. The isolator arms attachment of claim 1, wherein the first arm further comprises a first section and a second section, the second section extending away from the first section at an angle of less than 180 degrees and more than 90 degrees.

3. The isolator arms attachment of claim 1, wherein the first arm comprises a lattice design.

4. The isolator arms attachment of claim 1, wherein the first counterweight assembly further comprises a counterweight coupled to a counterweight plate, the counterweight plate attached to the first arm via a spring-loaded locking pin extending through the counterweight plate and into the first arm.

5. The isolator arms attachment of claim 1, wherein the first shaft is coupled to a shaft bolt, the shaft bolt extending through a bearing shaft as part of the first arm, wherein the shaft bolt is rotatable within the bearing shaft.

6. The isolator arms attachment of claim 5, further comprising an adjustment plate coupled to the bearing shaft and a spring pin configured to lock the first arm at a position about the shaft bolt.

7. An exercise system with an isolator arms attachment, comprising:

a support structure with a first vertical post and a second vertical post;

a first carriage adjustably secured to the first vertical post, the first carriage having a first set of carriage receivers;

a second carriage adjustably secured to the second vertical post, the second carriage having a second set of carriage receivers;

a first arm extending from a first end to a second end and engaged with the first carriage to couple the first arm to the support structure, the first arm having:

a first receiver assembly positioned at the first end, the first receiver assembly configured to engage with a first user engageable device, the first receiver assembly having a first receiver with a first locking pin and a second receiver with a second locking pin, the first receiver and the second receiver are each a hexagonal shaped opening extending into the first arm from a top surface of the first arm and the first locking pin and the second locking pin extend into the first receiver and the second receiver from an outward side of the first arm;

a first shaft coupled to the first arm near the second end, the first shaft configured to connect the first arm to the exercise system; and a first counterweight assembly coupled to the first arm near the second end;

a second arm extending from a first end to a second end and engaged with the second carriage to couple the second arm to the support structure, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

wherein the first arm and the second arm are configured to be manipulated by a user such that the first arm and the second arm provide resistance to the user.

8. The system of claim 7, wherein the first arm comprises a lattice design.

9. The system of claim 7, wherein the first counterweight assembly further comprises a counterweight coupled to a counterweight plate, the counterweight plate attached to the first arm via a spring loaded locking pin extending through the counterweight plate and into the first arm.

10. The system of claim 7, wherein the first arm further comprises:

a shaft bolt coupled to the first shaft;

a bearing shaft integral with the first arm at the second end;

an adjustment plate coupled to the bearing shaft; and a spring pin extending through the adjustment plate;

wherein the shaft bolt extends through the bearing shaft such that the shaft bolt can rotate within the bearing shaft; and wherein the spring pin and the adjustment plate are configured to allow for the first arm to adjust about the shaft bolt and lock into a position.

11. The system of claim 7, wherein the first set of carriage receivers further comprises a first carriage receiver extending to a right of the carriage and a second carriage receiver extending to a left of the carriage.

12. The system of claim 7, further comprises a first weight arm coupled to the first carriage and a second weight arm coupled to the second carriage, wherein the first weight arm and the second weight arm are configured to receive one or more weights to increase the resistance applied to the first arm and the second arm.

13. The system of claim 7, further comprising a first handle coupled to the first receiver assembly and a second handle coupled to the second receiver assembly.

14. The system of claim 7, further comprising a foot plate coupled to a bar, the bar configured to extend between the first receiver assembly of the first arm and the second receiver assembly of the second arm such that the bar is coupled to the first arm and the second arm.

15. An isolator arm as part of an exercise system, the isolator arm comprising:

a first section and a second section, the second section extending away from the first section at an angle between 180 degrees and 90 degrees;

a first receiver assembly positioned at a first end of the isolator arm, the first receiver assembly being a first hexagonal opening and a second hexagonal opening into the first section of the isolator arm;

a first locking pin extending into the first receiver assembly to lock a user engageable device therein;

a second locking pin extending into the second receiver assembly to lock the user engageable device therein;

a counterweight assembly removably attached to the second section of the isolator arm, the counterweight assembly having a counterweight plate supporting a counterweight, the counterweight plate configured to couple to the second section via a counterweight locking pin;

a bearing shaft positioned at the second end of the isolator arm;

an adjustment plate attached to the bearing shaft;

a shaft bolt integral with a shaft, the shaft bolt configured to extend through the bearing shaft such that the bearing shaft and the isolator arm can rotate around the shaft bolt; and a locking pin configured to lock the isolator arm at a position about the shaft bolt by extending through the adjustment plate;

wherein the isolator arm is configured to be manipulated by a user and provide resistance to the user.

16. An isolator arms attachment for an exercise system, the isolator arms attachment comprising:

a first arm extending from a first end to a second end, the first arm having:

a first receiver assembly positioned at the first end, the first receiver assembly configured to engage with a first user engageable device;

a first shaft coupled to the first arm near the second end, the first shaft configured to connect the first arm to the exercise system; and a first counterweight assembly coupled to the first arm near the second end, the first counterweight assembly having a counterweight coupled to a counterweight plate, the counterweight plate attached to the first arm via a spring-loaded locking pin extending through the counterweight plate and into the first arm;

a second arm extending from a first end to a second end, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

wherein the first arm and the second arm are configured to be manipulated by a user such that the first arm and the second arm provide resistance to the user.

17. An isolator arms attachment for an exercise system, the isolator arms attachment comprising:

a first arm extending from a first end to a second end, the first arm having:

a first receiver assembly positioned at the first end, the first receiver assembly configured to engage with a first user engageable device;

a first shaft coupled to the first arm near the second end, the first shaft configured to connect the first arm to the exercise system; and a first counterweight assembly coupled to the first arm near the second end;

a second arm extending from a first end to a second end, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

wherein the first arm and the second arm are configured to be manipulated by a user such that the first arm and the second arm provide resistance to the user; and through a bearing A wherein the first shaft is coupled to a shaft bolt, the shaft bolt extending through a bearing shaft as part of the first arm, wherein the shaft bolt is rotatable within the bearing shaft.

18. The isolator arms attachment of claim 17, further comprising an adjustment plate coupled to the bearing shaft and a spring pin configured to lock the first arm at a position about the shaft bolt.

19. An exercise system with an isolator arms attachment, comprising:

a support structure with a first vertical post and a second vertical post;

a first carriage adjustably secured to the first vertical post, the first carriage having a first set of carriage receivers;

a second carriage adjustably secured to the second vertical post, the second carriage having a second set of carriage receivers;

a first arm extending from a first end to a second end and engaged with the first carriage to couple the first arm to the support structure, the first arm having:

a first receiver assembly positioned at the first end, the first receiver assembly configured to engage with a first user engageable device;

a first shaft coupled to the first arm near the second end, the first shaft configured to connect the first arm to the exercise system; and a first counterweight assembly coupled to the first arm near the second end, the first counterweight assembly having a counterweight coupled to a counterweight plate, the counterweight plate attached to the first arm via a spring loaded locking pin extending through the counterweight plate and into the first arm;

a second arm extending from a first end to a second end and engaged with the second carriage to couple the second arm to the support structure, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

wherein the first arm and the second arm are configured to be manipulated by a user such that the first arm and the second arm provide resistance to the user.

20. An exercise system with an isolator arms attachment, comprising:

a support structure with a first vertical post and a second vertical post;

a first carriage adjustably secured to the first vertical post, the first carriage having a first set of carriage receivers;

a second carriage adjustably secured to the second vertical post, the second carriage having a second set of carriage receivers;

a first arm extending from a first end to a second end and engaged with the first carriage to couple the first arm to the support structure, the first arm having:

a first receiver assembly positioned at the first end, the first receiver assembly configured to engage with a first user engageable device;

a first shaft coupled to the first arm near the second end, the first shaft configured to connect the first arm to the exercise system;

a first counterweight assembly coupled to the first arm near the second end;

a shaft bolt coupled to the first shaft;

a bearing shaft integral with the first arm at the second end;

an adjustment plate coupled to the bearing shaft; and a spring pin extending through the adjustment plate;

wherein the shaft bolt extends through the bearing shaft such that the shaft bolt can rotate within the bearing shaft; and wherein the spring pin and the adjustment plate are configured to allow for the first arm to adjust about the shaft bolt and lock into a position;

a second arm extending from a first end to a second end and engaged with the second carriage to couple the second arm to the support structure, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

wherein the first arm and the second arm are configured to be manipulated by a user such that the first arm and the second arm provide resistance to the user.

21. An exercise system with an isolator arms attachment, comprising:

a support structure with a first vertical post and a second vertical post;

a first carriage adjustably secured to the first vertical post, the first carriage having a first set of carriage receivers;

a second carriage adjustably secured to the second vertical post, the second carriage having a second set of carriage receivers;

a first arm extending from a first end to a second end and engaged with the first carriage to couple the first arm to the support structure, the first arm having:

a first receiver assembly positioned at the first end, the first receiver assembly configured to engage with a first user engageable device;

a first shaft coupled to the first arm near the second end, the first shaft configured to connect the first arm to the exercise system; and a first counterweight assembly coupled to the first arm near the second end;

a second arm extending from a first end to a second end and engaged with the second carriage to couple the second arm to the support structure, the second arm having:

a second receiver assembly positioned at the first end, the second receiver assembly configured to engage with a second user engageable device;

a second shaft coupled to the second arm near the second end, the second shaft configured to connect the second arm to the exercise system; and a second counterweight assembly coupled to the second arm near the second end;

a foot plate coupled to a bar, the bar configured to extend between the first receiver assembly of the first arm and the second receiver assembly of the second arm such that the bar is coupled to the first arm and the second arm;

wherein the first arm and the second arm are configured to be manipulated by a user such that the first arm and the second arm provide resistance to the user.

* * * * *